US010555598B2

(12) United States Patent
Evans et al.

(10) Patent No.: US 10,555,598 B2
(45) Date of Patent: Feb. 11, 2020

(54) ATTACHMENT APPARATUS FOR MODULAR LOAD-CARRYING DEVICES

(71) Applicants: Martin Cameron Evans, Saratoga Springs, UT (US); Garrett Lommatsch, Orem, UT (US)

(72) Inventors: Martin Cameron Evans, Saratoga Springs, UT (US); Garrett Lommatsch, Orem, UT (US)

( * ) Notice: Subject to any disclaimer, the term of this patent is extended or adjusted under 35 U.S.C. 154(b) by 0 days.

(21) Appl. No.: 16/019,162

(22) Filed: Jun. 26, 2018

(65) Prior Publication Data

US 2018/0368560 A1 Dec. 27, 2018

Related U.S. Application Data

(60) Provisional application No. 62/524,977, filed on Jun. 26, 2017.

(51) Int. Cl.

| | |
|---|---|
| ***A45F 5/02*** | (2006.01) |
| ***A45F 3/06*** | (2006.01) |
| *A45F 3/00* | (2006.01) |

(52) U.S. Cl.

CPC ..... *A45F 5/02* (2013.01); *A45F 3/06* (2013.01); *A45F 2003/001* (2013.01); *A45F 2005/023* (2013.01); *A45F 2200/05* (2013.01)

(58) Field of Classification Search

CPC .... A45F 5/02; A45F 5/021; A45F 5/00; A45F 3/14; A45F 3/06; A45F 2200/0591; A45F 2003/001

See application file for complete search history.

(56) References Cited

U.S. PATENT DOCUMENTS

| | | | | |
|---|---|---|---|---|
| 7,080,430 | B2 * | 7/2006 | Wemmer | A41D 13/0012 24/578.13 |
| 8,297,562 | B1 * | 10/2012 | Yeates | A45F 5/02 224/191 |
| 8,713,764 | B1 * | 5/2014 | Rittenhouse | A45F 5/02 24/3.11 |
| 10,299,574 | B1 * | 5/2019 | Chen | A45F 5/02 |
| 2007/0289045 | A1 * | 12/2007 | Evans | A45F 3/06 2/102 |
| 2013/0047386 | A1 * | 2/2013 | Barfoot | A47F 5/0006 24/580.1 |
| 2015/0182011 | A1 * | 7/2015 | Mccrone | A45F 5/02 224/191 |
| 2015/0189977 | A1 * | 7/2015 | Thompson | A45F 5/02 24/3.7 |
| 2019/0075916 | A1 * | 3/2019 | Becker | A45F 5/02 |

* cited by examiner

*Primary Examiner* — Corey N Skurdal

(74) *Attorney, Agent, or Firm* — Terrence J. Edwards; TechLaw Ventures, PLLC

(57) ABSTRACT

Systems, methods, and devices for securing an accessory to a modular load-carrying device are disclosed. An attachment apparatus for securing an accessory to a modular load-carrying device is disclosed. The attachment apparatus includes a bridge and further includes a connector having a first end, a body portion, and a second end. The attachment apparatus includes an attachment mechanism securing the connector to the bridge.

25 Claims, 7 Drawing Sheets

ATTACHMENT APPARATUS FOR MODULAR LOAD-CARRYING DEVICES

CROSS-REFERENCE TO RELATED APPLICATIONS

This application claims the benefit of U.S. Provisional Application No. 62/524,977, filed Jun. 26, 2017, titled "RIGID ATTACHMENT DEVICE," which is hereby incorporated by reference in its entirety, including but not limited to those portions that specifically appear hereinafter, the incorporation by reference being made with the following exception: In the event that any portion of the above-referenced provisional application is inconsistent with this application, this application supersedes said above-referenced provisional application.

STATEMENT REGARDING FEDERALLY SPONSORED RESEARCH OR DEVELOPMENT

Not Applicable.

TECHNICAL FIELD

The disclosure relates to systems, methods, and devices for modular equipment carrying and particularly relates to systems, methods and devices for quick attachment and release of modular equipment to a load carrying device or garment.

BACKGROUND

Numerous systems and devices are known for carrying equipment on a person, animal, or device. Such systems and devices are particularly common among military and law enforcement personnel and may be configured to carry safety equipment, weaponry, and so forth. Accessory devices configured to hold individual items may be removably attached to wearable clothing such as a vest or jacket. One such system utilized among military and law enforcement personnel is Modular Lightweight Load-carrying Equipment (hereinafter "MOLLE") utilized in combination with a Pouch Attachment Ladder System (hereinafter "PALS"). The MOLLE system includes the use of a carrying device or garment that may be worn by a user such as a person or animal. Commonly, the MOLLE system is utilized as a vest, waist belt, panel added to a piece of equipment, backpack, jacket, fanny pack, or the like. The MOLLE system includes PALS webbing that typically includes a grid of repeating fabric webbing strips that may be oriented in a horizontal grid pattern. The MOLLE system further includes accessories configured to attach to the carrying device or garment via the PALS webbing. The MOLLE accessory further includes PALS webbing that corresponds with the PALS webbing of the MOLLE carrying device or garment.

The MOLLE system is utilized in various military and law enforcement scenarios where a user wishes to secure one or more accessories to a carrying device or garment. A user may wish to secure MOLLE-compatible accessories in multiple locations on a carrying device. The user may further wish to quickly attach and remove the accessories. The MOLLE system provides secure attachment of various accessories to a carrying device or garment but the system can be difficult and time-consuming to use when trying to attach or remove various accessories.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with respect to the following description and accompanying drawing where.

DETAILED DESCRIPTION

Figure 1A:
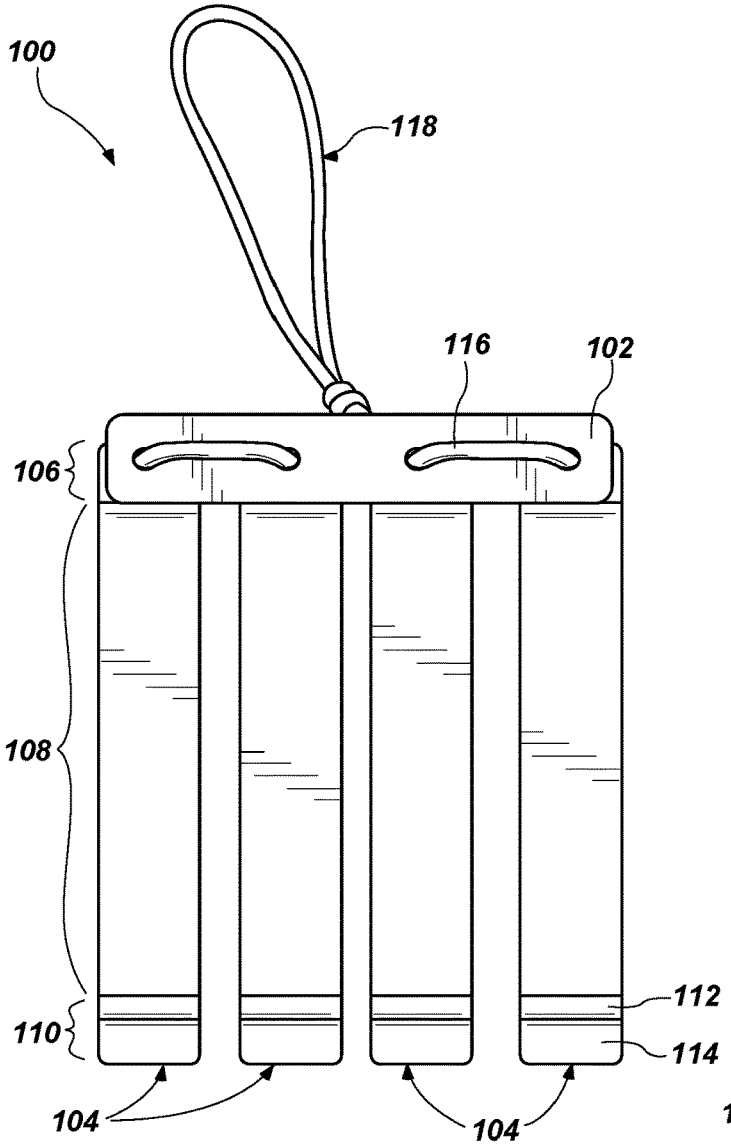
FIGS. 1A and 1B illustrate aerial views of embodiments of an attachment apparatus, according to embodiments of the disclosure.

The disclosure extends to methods, systems, apparatuses, and devices for quick attachment and release of a modular device to a load carrying device or garment. The disclosure particularly extends to methods, systems, apparatuses, and devices for use in connection with MOLLE systems that include PALS webbing.

Embodiments of the disclosure are configured to provide quick and convenient attachment and release of modular accessories to a MOLLE system. An apparatus of the disclosure is optimized for securely attaching a modular accessory to a MOLLE system such that the modular accessory may be quickly attached and removed. In an embodiment, an apparatus of the disclosure provides for detachment of a MOLLE/PALS modular accessory from a MOLLE/PALS device or garment by removing all attachment points simultaneously in approximately one-second.

In a common implementation, the MOLLE attachment grid system includes horizontal rows of one-inch nylon webbing spaced one inch apart. The nylon webbing is attached to a backing, e.g., a carrying device or garment, at 1.5-inch intervals. The MOLLE system may be constructed of various fabrics and is commonly constructed of nylon fabrics.

The MOLLE system is commonly utilized among military and law enforcement personnel and is further utilized by users engaging in outdoor activities such as camping, hunting, fishing, and the like. The MOLLE system provides flexibility and modularity in how accessories are attached to the carrying device or garment. Various accessories have been developed and adapted for the MOLLE system, however, such accessories are often difficult and time-consuming to attach and remove from the MOLLE system. Many of the available accessories require tedious weaving of a flimsy material through the PALS to attach the accessory to the MOLLE platform. The process of removing the accessory is equally tedious and cannot be performed quickly in a high-risk scenario. Additionally, in the case of a wearable garment such as a vest or backpack, it can be very difficult to attach or remove an accessory to the back of the garment when it is worn by a user. Various attachment mechanisms known in the art require two-handed removal of the accessory from the MOLLE platform and prohibit the user from, for example, carrying a weapon or other gear in one hand while removing the accessory.

The PALS/MOLLE systems were originally designed for tactical applications. Consequently, users are often in precarious situations where time can be a critical factor in the success or failure of missions and can tip the balance between life and death. Limitations plague everyone who loads a PALS/MOLLE vest with the existing connectors. Military and law enforcement personnel along with tactical professionals and recreationists often struggle with attaching and removing MOLLE accessories. In various tactical scenarios, the time-consuming difficulty of removing a MOLLE accessory can lead to a failed mission and may even lead to injury or death.

Many military and law enforcement personnel are issued a 20-30-pound bullet proof vest including the PALS/MOLLE attachment foundation. Depending on the user's role and function, the user may need to carry an additional 20-30 pounds in gear. Such gear may include, for example, communication equipment, ammunition, weaponry, safety equipment, and medical equipment. A fully equipped individual may be carrying upwards of 40-60 pounds of gear. However, due to the limitations of current connectors in the PALS/MOLLE attachment systems, it is not practical for the user to evenly distribute the weight around the entire vest because it will inhibit the user's ability to effectively access or utilize any gear mounted to the back panel of the vest. As a result, the user will often carry the majority of the weight on the front of the vest. This causes a poor weight distribution that can lead to various physiological ailments including back pain, abdominal pain, and so forth.

Commonly, due to the poor distribution of weight on the vest, the user suffers injury resulting from fatigue. The MOLLE/PALS vest system is heavily weighted to the front and this causes biomechanical ineffectiveness. The front-loaded weight causes the user to fight the forward-pulling gravity of the gear to stay upright. Thus, a user wastes a great deal of energy on fighting the distribution of weight on the vest and this can cause ineffectiveness for the user that may lead to a failure in the mission, injury, or even death.

Additionally, valuable space on the MOLLE carrying device may be wasted because the user must front-load all accessories that the user may wish to quickly and efficiently access. As a result of attaching most accessories at the front of the vest, nearly half of the valuable space on the PALS/MOLLE system is not utilized. The user may carry additional accessories if the user were able to quickly access or detach the accessories at the rear portion of the garment.

Previously disclosed connectors for the PALS/MOLLE system require each attachment structure to be engaged independently of the other attachment structure. As nearly all PALS/MOLLE accessories require two or more connecting structures to secure the PALS/MOLLE accessory to the PALS/MOLLE foundation, the time required to remove or attach a PALS/MOLLE accessory from a PALS/MOLLE foundation is multiplied by the number of attachment structures to be removed. Such known attachment structures are time consuming and inefficient for the quick and flexible use of the PALS/MOLLE attachment grid system, especially the quick removal of an accessory from a platform.

Applicant recognizes the deficiencies in the systems and devices in the prior art and discloses herein a rigid connector for quick attachment and detachment of accessories to a MOLLE/PALS system. The systems and devices of the disclosure enable a user to balance heavy loads around a full circumference of a garment to minimize biomechanical inefficiencies and utilize the full benefits of the garment.

A detailed description of systems and methods consistent with embodiments of the present disclosure is provided below. While several embodiments are described, it should be understood that this disclosure is not limited to any one embodiment, but instead encompasses numerous alternatives, modifications, and equivalents. In addition, while numerous specific details are set forth in the following description in order to provide a thorough understanding of the embodiments disclosed herein, some embodiments may be practiced without some or all of these details. Moreover, for the purpose of clarity, certain technical material that is known in the related art has not been described in detail in order to avoid unnecessarily obscuring the disclosure.

In the following description, reference is made to the accompanying drawings that form a part thereof, and in which is shown by way of illustration specific exemplary embodiments in which the disclosure may be practiced. These embodiments are described in sufficient detail to enable those skilled in the art to practice the concepts disclosed herein, and it is to be understood that modifications to the various disclosed embodiments may be made, and other embodiments may be utilized, without departing from the scope of the present disclosure. The following detailed description is, therefore, not to be taken in a limiting sense.

Reference throughout this specification to "one embodiment," "an embodiment," "one example" or "an example" means that a particular feature, structure or characteristic described in connection with the embodiment or example is included in at least one embodiment of the present disclosure. Thus, appearances of the phrases "in one embodiment," "in an embodiment," "one example" or "an example" in various places throughout this specification are not necessarily all referring to the same embodiment or example. Furthermore, the particular features, structures, databases or characteristics may be combined in any suitable combinations and/or sub-combinations in one or more embodiments or examples. In addition, it should be appreciated that the figures provided herewith are for explanation purposes to persons ordinarily skilled in the art and that the drawings are not necessarily drawn to scale.

Figure 1B:
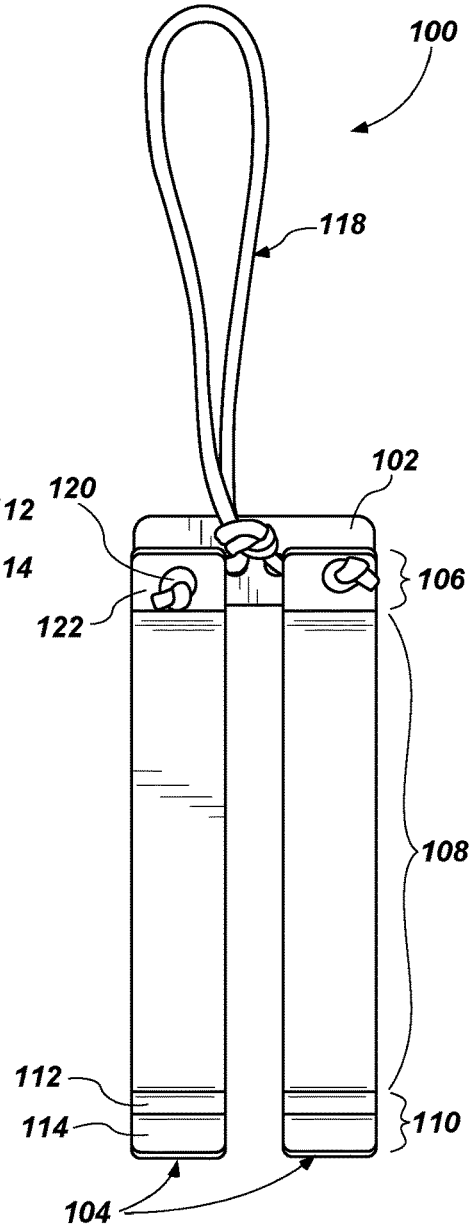

Referring now to the figures, FIGS. 1A and 1B illustrate embodiments of an attachment apparatus 100. FIG. 1A illustrates an attachment apparatus 100 including four connectors 104 and FIB. 1B illustrates an attachment apparatus 100 including two connectors 104. The attachment apparatus 100 includes a bridge 102 that may comprise one or more holes disposed therethrough. The attachment apparatus 100 includes one or more connectors 104, each comprising a first end 106, a body portion 108, and a second end 110. The first end 106 of the connector 104 may comprise one or more holes disposed therethrough. In an implementation, the connector 104 may comprise one or more holes disposed through any portion of the connector 104. In another implementation, the connector 104 may not have any holes disposed therethrough. The attachment apparatus 100 may include a cord 116 or other attachment mechanism (both of which may alternatively be referred to herein as an attachment mechanism) configured to secure the bridge 102 to the one or more connectors 104. In one implementation, this may be done by passing the attachment mechanism through the hole of the bridge 102 and the hole of the one or more connectors 104. The cord 116 may include a loop 118 or other mechanical structure, including but not limited to an additional rigid piece of material acting as a handle for a user to grip, disposed above the bridge 102 such that a user may grip the loop 118 to move or remove the attachment apparatus 100. In an implementation, the cord 116 may include one or more knots 120 to secure the cord 116 through the holes disposed through each of the bridge 102 and the one or more connectors 104. The first end 106 of the connector 104 may be proximal to the bridge 102 and may include an angled portion 122. The second end 110 of the connector 104 may be distal to the bridge 102 and may include a first angled portion 112 and a second angled portion 114. It will be appreciated that the angled portions 112 and 114 may both have the angled surface facing the same or similar direction, or in opposite or dissimilar directions without departing from the scope of the disclosure.

The attachment apparatus 100 disclosed herein provides for immediate detachment of an entire PALS/MOLLE accessory from a PALS/MOLLE foundation (also referred to as a carrying device). The connectors 104 serve as a rigid universal connector system for attaching and detaching the accessory to the foundation. The attachment apparatus 100 disclosed herein does not require the use of a mechanical part such as a snap, a bracket, a clip, or so forth to ensure the accessory is securely attached to the foundation.

The bridge 102 provides a means for each of a plurality of connectors 104 to be secured to the bridge 102 in a row as illustrated in FIGS. 1A and 1B. The bridge 102 is designed such that each of the connectors 104 can be removed simultaneously for quick release of PALS/MOLLE accessory from a PALS/MOLLE foundation, such as a carrying device or garment. In an embodiment, the bridge 102 includes a plurality of holes disposed therethrough in a line such that a plurality of connectors 104 may be secured to the bridge 102. In an embodiment, the bridge 102 comprises a flat surface constructed of a flexible, semi-rigid or rigid material such as a webbing for ease of threading, or a polycarbonate, or metal, or wood, and so forth. The loop 118 of the cord 116 begins at the bridge 102 and the cord is knotted at the bridge 102 to form the loop 118. When a user pulls the loop 118 to extract the attachment apparatus 100 from a MOLLE system, the bridge 102 ensures the plurality of connectors 104 are extracted from the MOLLE system at one time, thereby freeing the PALS/MOLLE accessory from the PALS/MOLLE foundation.

The bridge 102 may be a flat, non-contoured piece affixed approximately normal to the connectors 104. The bridge 102 is configured to join the connectors 104 with the cord 116 or other attachment mechanism to permit the entire attachment apparatus 100 to be removed simultaneously and quickly. The bridge 102 secures the connectors 104 in a prescribed spacing corresponding and according to the spacing of the corresponding attachment mechanism, such as holes, disposed through the bridge 102. The bridge 102 provides additional security against unintentional displacement or movement of a connector 104. Further, the bridge 102 is instrumental in the rapid and simultaneous extraction of the plurality of connectors 104 when desired. In an embodiment, the bridge 102 includes two or more layers laminated together or places on either side of the connectors 104 for increased rigidity. In an embodiment, the bridge 102 may be constructed of the same material as the connectors 104. In an alternative embodiment, the bridge 102 may be constructed of a different material than the connectors 104. The ends of the bridge 102 may be square, rounded, or any other suitable shape that does not disrupt the use of the attachment apparatus 100.

The bridge 102 may be attached to the one or more connectors 104 via one or more holes and a cord 116 as illustrated in FIGS. 1A and 1B. Alternatively, the connectors 104 may be attached to the bridge 102 via an attachment mechanism, such as a bracket, a snap, an adhesive, etc., or may be constructed as a single, unitary piece comprising the bridge 102 and the one or more connectors 104. In such an embodiment, the attachment apparatus 100 might not have any holes and might not include a cord 116 configured to attach the bridge 102 to the one or more connectors 104. It will be appreciated that all attachment mechanisms for attaching the bridge 102 to the one or more connectors 104 are contemplated by the disclosure.

The connector 104 is secured to the bridge 102 and is configured to be fed through one or more loops of a PALS/MOLLE system. The attachment apparatus 100 includes varying numbers of connectors 104 in varying embodiments. In the two embodiments illustrated in the FIGS. 1A and 1B, the attachment apparatus 100 includes four or two connectors 104. It should be appreciated the attachment apparatus 100 may include any number of connectors 104 as required to secure a particular MOLLE-compatible accessory to a MOLLE carrying device. In an embodiment, the connector 104 includes a flat surface and is constructed of a flexible, semi-rigid or rigid material such as a webbing for ease of threading, polycarbonate, metal, wood, carbon fiber, fiberglass, epoxy, resin, laminate, injection molded plastic, and so forth.

In an embodiment, the connectors 104 are threaded through the PALS/MOLLE webbing or loops of the accessory and foundation. The plurality of connectors 104 are each connected to the bridge 102 such that the plurality of connectors 104 form a uniform line that may be threaded through a PALS/MOLLE system. In an embodiment, the connectors 104 are configured to fit into a standard 1.5 inch spacing between sewn loops on the PALS/MOLLE system to prevent slippage and provide a secure fit of the accessory to the foundation.

The connectors 104 may include a hole disposed therethrough at a proximal end near the bridge 102 as illustrated in FIGS. 1A and 1B. The connectors 104 may include any number of holes and the holes may be disposed therethrough at any number of suitable locations, including for example, at a distal end farther from the bridge 102, in the middle, and so forth. The hole may be utilized to attach the connector 104 to the bridge 102 or may be utilized for any other suitable purpose, including to provide additional stability in securing the attachment apparatus 100 to a PALS/MOLLE foundation in various embodiments.

The connectors 104 may have smooth or textured sides including additional ridges, grooves, cutouts, or structures intended to facilitate additional flexibility or stiffness, depending on the shape and design. Additional laminated layers may be added across a portion or the entirety of the connector 104 to further enhance the desired characteristics. The thickness of the connector 104 may vary depending on the material used, the texture or contours added, and the intended use of the connector 104 with varying accessories. Similarly, the thickness of the connector 104 may vary along the length of the connector. For example, in an embodiment where weight reduction is desired, the body portion 108 may be thinner than either of the first end 106 or the second end 108.

The bridge 102 may be attached to the connectors 104 by a permanent or removable option. The bridge 102 may be attached to the connectors 104 by a cord 116 as illustrated in FIGS. 1A and 1B, or it may alternatively be attached by other types of cord, plastic, natural materials, fibers, synthetics, metal wires, or other material that may be threaded through the holes of the bridge 102 and the corresponding holes of the connectors 104. The joints formed by the attachment of the connectors 104 to the bridge 102 may be flexible as illustrated in FIGS. 1A and 1B or alternatively may be rigid using a permanent or semi-permanent means of attachment by way of, for example, epoxies, glues, rivets, snaps, welds, or similar attachment methods. Additionally, the bridge 102 and the connectors 104 may be formulated as a single piece without a joint and may be formed of, for example, a single component of injection-molded plastic. Other attachment mechanisms may be utilized by the disclosure to attach the bridge 102 and the connectors 104, such as a mechanical interaction between the bridge 102 and the connectors 104, including geometrical connections, snap fits, press fits, inserts, mechanical fasteners, sewing or stitching, heat welding and sealing, ultrasonic assembly, and solvent and adhesive bonding without departing from the scope of the disclosure.

The first end 106 of the connector 104 may be proximal to the bridge 102. The first end 106 may include a connector hole disposed therethrough (see 304) that matches a corresponding bridge hole (see 302) disposed through the bridge 102. The first end 106 of the connector 104 provides the connecting point whereby the connector 104 is secured to the bridge 102 via the cord 116 or other attachment mechanism. In varying embodiments of the disclosure, the connector 104 may be rigidly or permanently secured to the bridge 102 by way of other mechanisms previously mentioned. In an embodiment, the first end 106 may include a first angled portion and a second angled portion (see FIG. 7), where the hole is disposed through the distal-most angled portion. The angled portions of the first end 106 of the connector 104 are configured to provide additional friction to provide additional support in securing the MOLLE-compatible accessory to the MOLLE carrying device. The angled portions (may alternatively be referred to as a retention plate) provide positive engagement of the PALS/MOLLE loops to retain the accessory in its intended placement relative to the foundation. It will be appreciated that other mechanisms may be used to provide friction and/or additional support in securing the MOLLE-compatible accessory to the MOLLE carrying device without departing from the scope of the disclosure. For example, friction may be provided by a textured or patterned surface on one or more of the bridge 102 and the connectors 104.

The body portion 108 of the connector 104 includes a flat surface configured to extend the length of a MOLLE-compatible accessory. It should be appreciated that the body portion 108 may be of any suitable length to support a particular accessory. The body portion 108 includes a width configured to be disposed through one or more loops of each of a MOLLE-compatible accessory and a MOLLE carrying device. The body portion 108 may be constructed of any flexible, semi-rigid or rigid material, including for example a webbing for ease of threading, polycarbonate, a metal, a wood, and so forth.

Figure 7:
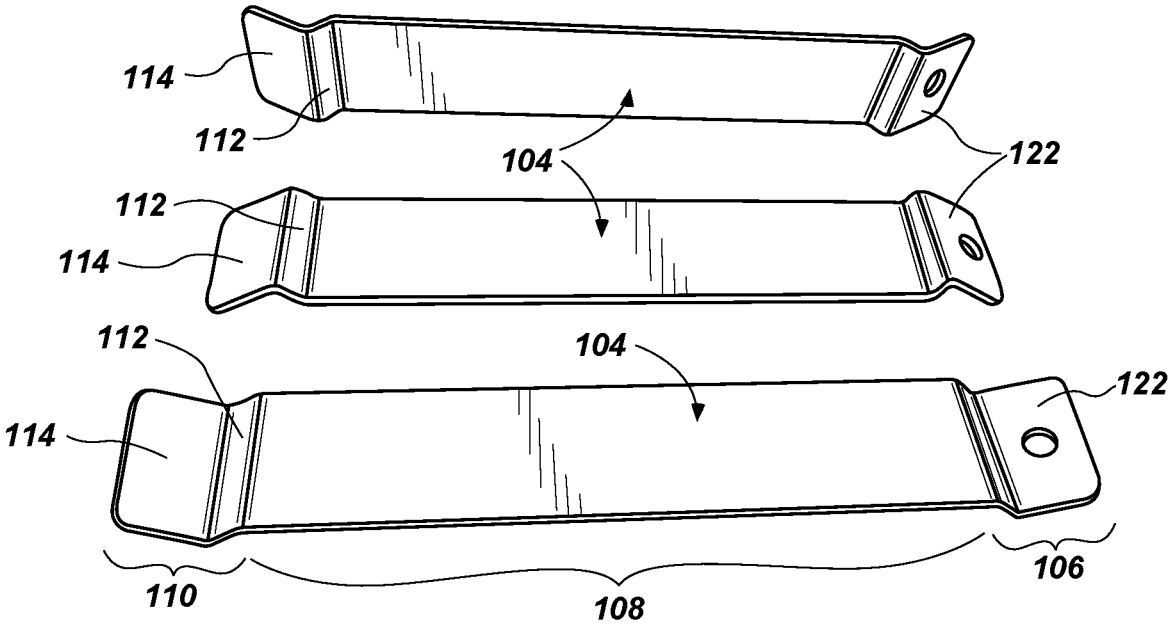
FIG. 7 illustrates various perspective views of a connector of an attachment apparatus, according to an embodiment of the disclosure.

The second end 110 of the connector 104 may be positioned distal to the bridge 102. As illustrated in FIG. 7, the second end 110 includes a first angled portion 112 and a second angled portion 114 relative to the flat surface of the body portion 108. The angled portions of the second end 110 are configured to provide additional friction and support when securing an accessory to a carrying device.

The cord 116 or other attachment mechanism provides a means of securing the connector 104 to the bridge 102. In an embodiment, the cord 116 is knotted at each of a plurality of connectors 104 to secure each of the plurality of connectors 104 individually to the bridge 102. In an embodiment, the cord 116 is configured to provide a loop 118 whereby a user may grip the cord 116 and remove the attachment apparatus to quickly remove an accessory from a carrying device. The cord 116 may be constructed of any suitable material and may preferably be constructed of a high-strength polyester material arranged in a braided construction.

In alternative embodiments, the loop 118 may be a grip or other structure and may not be constructed of the cord 116, but may instead include any suitable means for gripping the attachment apparatus 100 to provide a quick-release of an accessory from a PALS/MOLLE foundation. In an embodiment, the connector 104 and the bridge 102 include a single component without a joint and the attachment apparatus 100 does not include the cord 116. In such an embodiment, the loop 118 might not be a loop constructed of a cord but may instead include a handle, a notch, etc. constructed out of the same piece as the bridge 102 or secured to the bridge 102. In a further embodiment, the attachment apparatus 100 may include a loop 118 constructed of cording while the connector 104 is secured to the bridge 102 by a non-cord attachment mechanism such as a bracket, a clip, an adhesive, etc., or the bridge 102 and the connector 104 may constitute a single component formed of, for example, injection-molded plastic.

In an alternative embodiment, the attachment apparatus 100 includes a single piece including the bridge 102 and the connectors 104 such that a shape similar to that disclosed in FIGS. 1A and 1B is constructed without the use of a cord 116 to connect the bridge 102 to the connectors 104.

In an embodiment where additional security is needed and it is advantageous to prevent removal of the accessory in harsh conditions, the bridge 102 may comprise a plurality of bridges, such as a first bridge and a second bridge to lock the connectors 104. The first bridge 102 may be attached to the first end of the plurality of connectors 104 and the second bridge 102 may be attached to the second end of the plurality of connectors 104 to lock the plurality of connectors 104 at the first end and the second end in situations where locking down the accessory is advantageous. For example, the first bridge 102 may be added to the top of the connectors 104 while the second bridge 102 may be added to the bottom of the connectors 104 to completely lock in the connectors 104 from both the top and the bottom when additional security is needed and to prevent removal in harsh conditions. It will be appreciated that the bridge 102 may be secured or attached to the connectors 104 anywhere along the connector 104 and does not necessarily required to be attached at the first end or the second end. It will likewise be appreciated that there may only be one bridge used and another attachment mechanism may be used to lock in the connectors to the accessory, such as a cord, or other similar locking mechanism used in conjunction with the bridge without departing from the scope of the disclosure.

Figure 2:
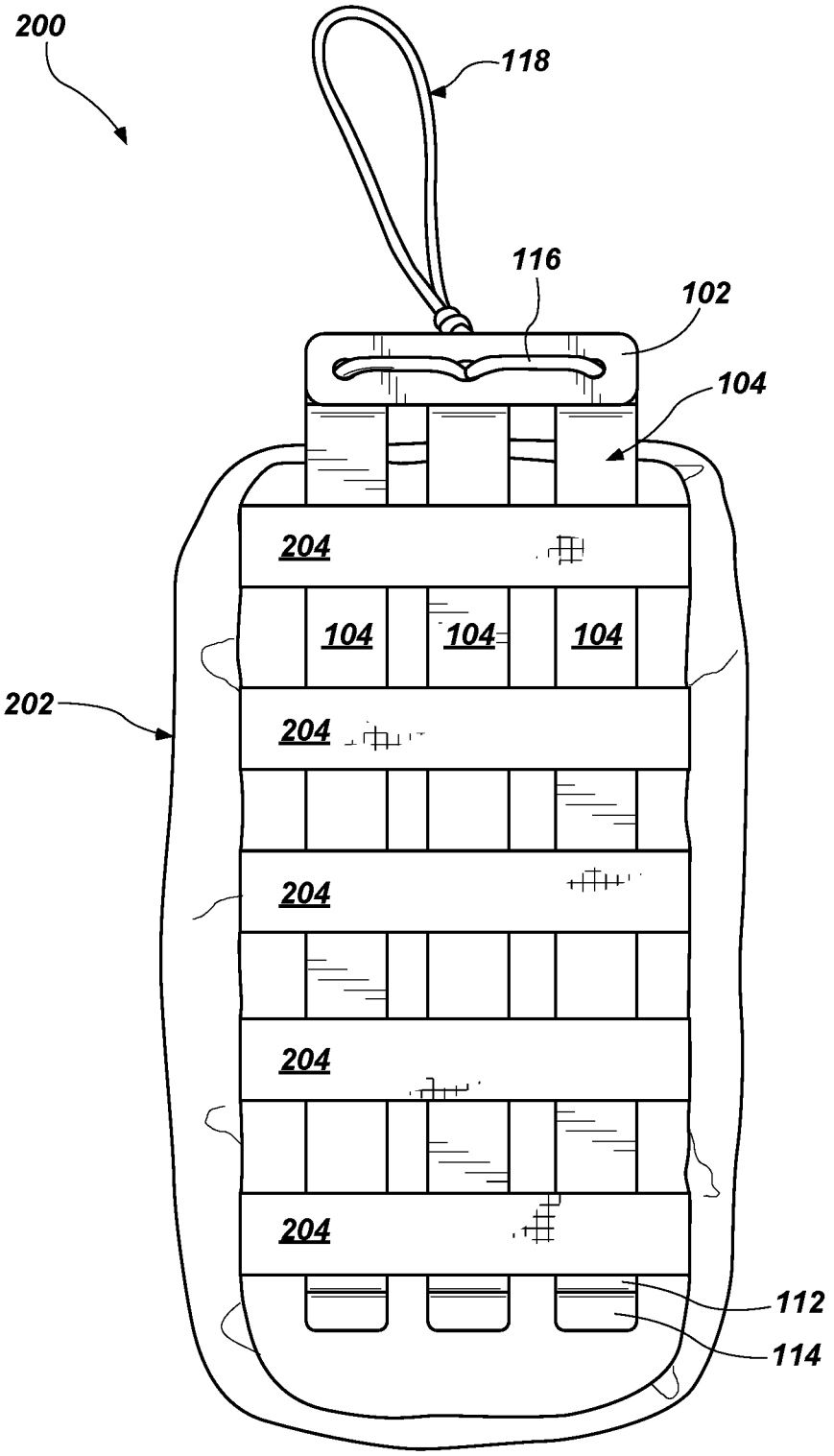
FIG. 2 illustrates a front view of an attachment apparatus threaded through a PALS/MOLLE system, according to an embodiment of the disclosure.

FIG. 2 illustrates a system 200 wherein an attachment apparatus 100 is threaded through an accessory 202 of a PALS/MOLLE system. The attachment apparatus 100 includes a bridge 102, one or more connectors 104 (three connectors 104 as illustrated in FIG. 2), and a cord 116 disposed through holes of the bridge 102 and holes of the connectors 104 to secure the connectors 104 to the bridge 102. The accessory 202 of the PALS/MOLLE system includes one or more loops 204 disposed horizontally across the accessory 202. As illustrated in FIG. 2, the connectors 104 of the attachment apparatus 100 are configured to be disposed through the loops 204 of the accessory 202.

Figure 3:
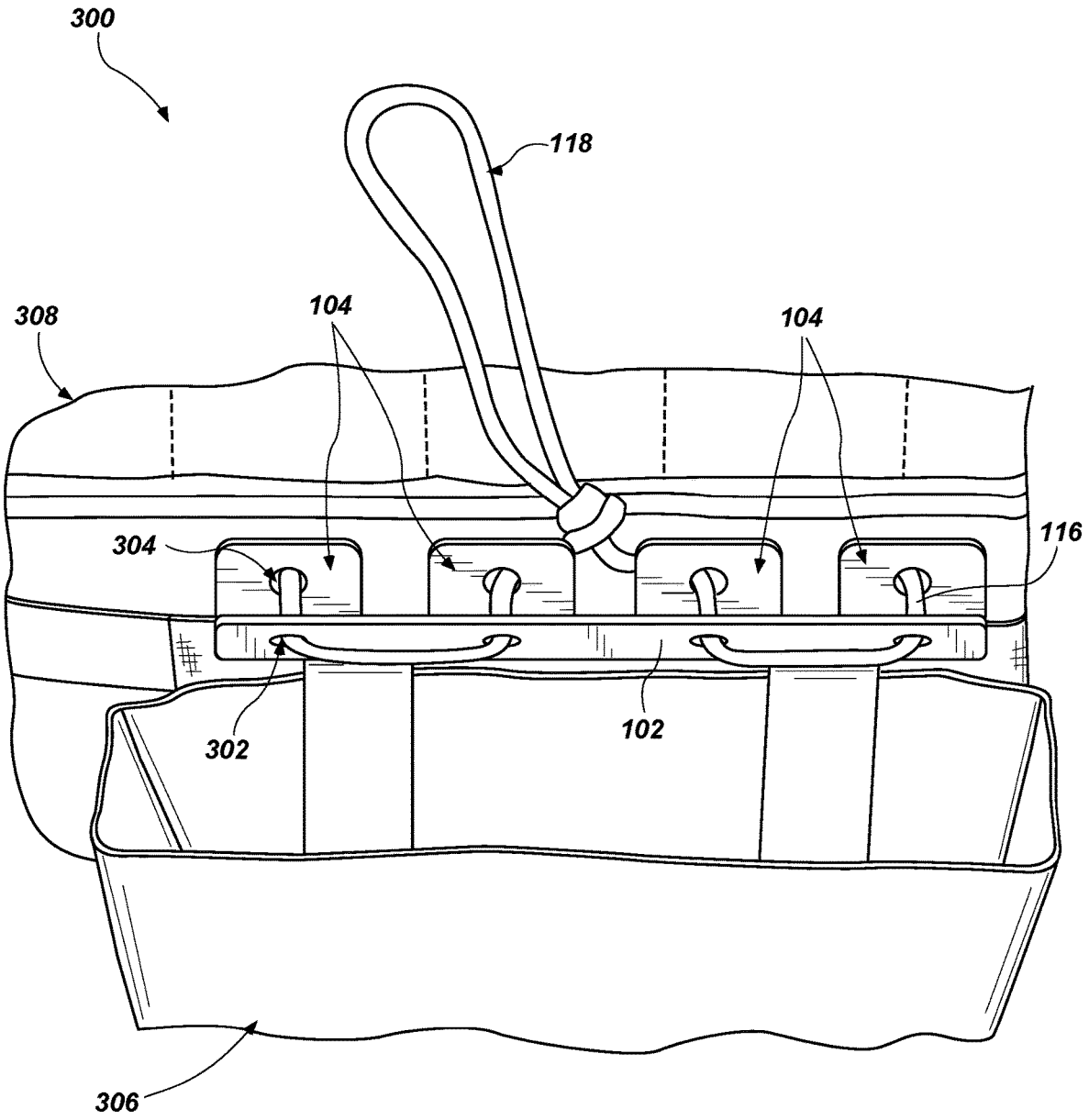
FIG. 3 illustrates a perspective view of a portion of an attachment apparatus securing an accessory with a PALS/MOLLE system, according to an embodiment of the disclosure.

FIG. 3 illustrates a perspective view of a system 300 wherein an attachment apparatus 100 is threaded through an accessory 306 of a PALS/MOLLE system and a carrying device 308 or garment of a PALS/MOLLE system. The carrying device 308 may include, for example, a garment such as a vest, jacket, pants, and so forth, or may include a carrying device such as a backpack, hip pack, duffel bag, and so forth. The accessory 306 of the PALS/MOLLE system may include any suitable accessory, including for example, one configured to hold safety gear, ammunition, weaponry, medical supplies, and so forth. The attachment apparatus 100 includes a bridge 102 and a plurality of connectors 104 secured to the bridge 102 by way of a cord 116. The bridge 102 includes one or more holes 302 disposed therethrough. The connectors 104 include a hole 304 disposed through the first end 106 of the connector 104.

One-inch webbing is the most common connector used to attach an accessory 306 to a carrying device 308 such as a bag or vest with PALS or the MOLLE system. The webbing is often already fixed to the gear and is then woven through the MOLLE webbing and snapped into place on the gear. Other options allow for folding the end of the strap in between the bag or vest and the gear rather than a snapping button or a Velcro type attachment. The main complaint with these traditional webbing connectors is the amount of time required to weave or remove the webbed strips. The flexibility and modularity of the system is hampered by the length of time and frustration endured by a user to affix gear using these traditional webbed strips. Finally, the webbed strips may deteriorate or tear through prolonged use.

Figure 4:
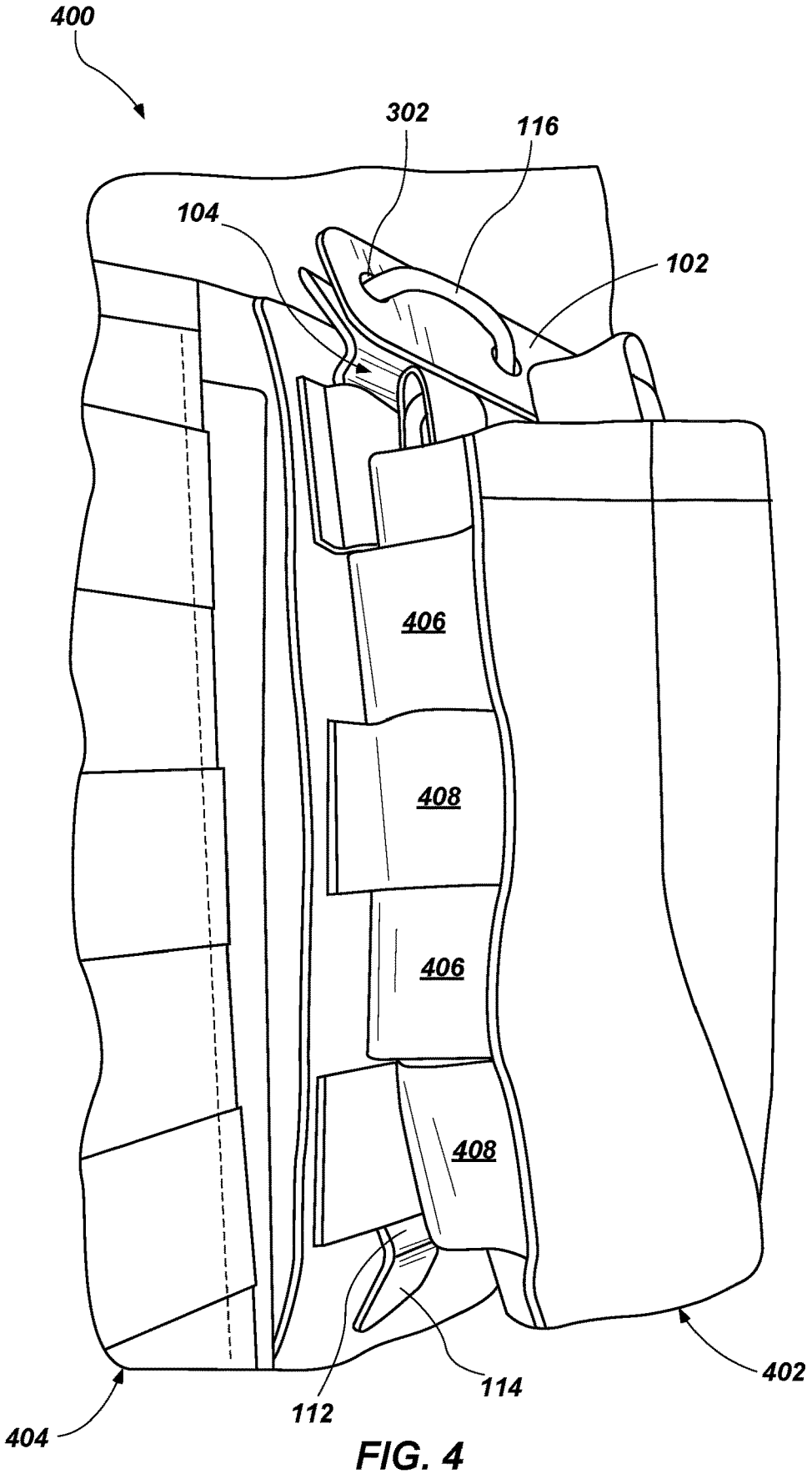
FIG. 4 illustrates a perspective view of an attachment apparatus securing an accessory with a PALS/MOLLE system, according to an embodiment of the disclosure.

FIG. 4 illustrates a side-perspective view of a system 400 wherein an attachment apparatus 100 secures an accessory 402 of a PALS/MOLLE system to a carrying device 404 (which may alternatively be referred to as a foundation) of a PALS/MOLLE system. The accessory 402 includes one or more loops 406 disposed horizontally across the accessory 402. The carrying device 404 includes one or more loops 406 disposed horizontally across the carrying device 404. The attachment apparatus 100 is configured to be disposed through the loops 406, 408 of the accessory and carrying device, respectively. A connector 104 of the attachment apparatus 100 may include a first angled portion 112 and a second angled portion 114 relative to a body portion 108 of the connector 104. Each of the first angled portion 112 and the second angled portion 114 may be configured to provide additional stability and friction to ensure the accessory 402 is securely attached to the carrying device 404 by way of the attachment apparatus 100.

Figure 5:
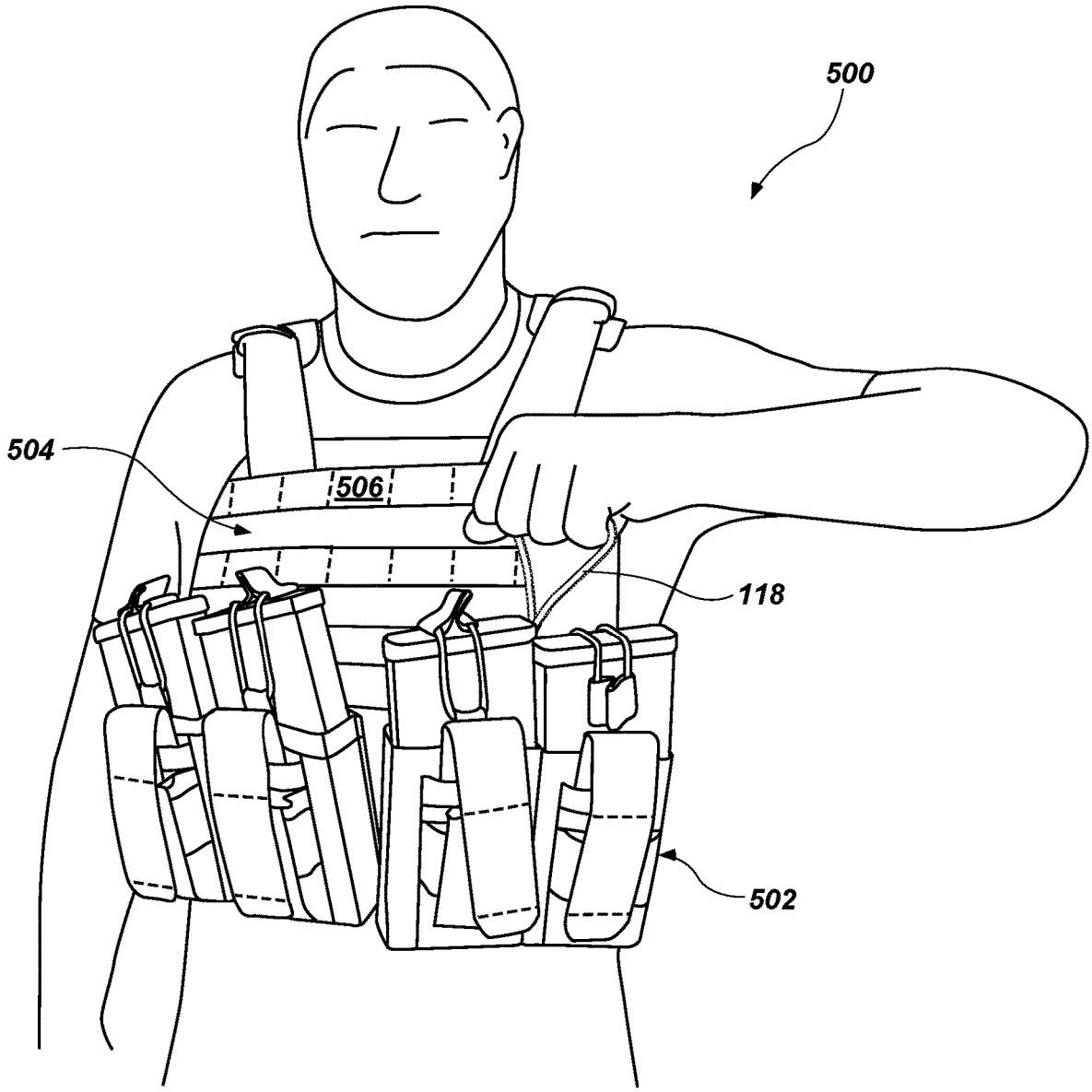
FIG. 5 illustrates a removal of an attachment apparatus to release an accessory, according to an embodiment of the disclosure.

FIG. 5 illustrates the removal 500 of an attachment apparatus 100 (not shown) such that an accessory 502 of a PALS/MOLLE system is released from the carrying device 504 (which may alternatively be referred to as a foundation) of the PALS/MOLLE system. The carrying device 504 includes one or more loops 506 secured thereon, wherein the one or more loops 506 are configured to support the accessory 502 attached to the carrying device 504. In an embodiment, a connector 104 of an attachment apparatus 100 (not shown) is configured to be disposed through one or more of the loops 506 of the carrying device 504 and further through one or more corresponding loops of an accessory 502 to secure the accessory 502 to the carrying device 504. To release the accessory 502 from the carrying device 504, the attachment apparatus 100 is pulled upward at the loop 118 or other structure such that the bridge 102 and connectors 104 of the attachment apparatus 100 (not shown) are pulled upward and out of the loops of each of the accessory 502 and the carrying device 504 thereby freeing the accessory 502 from the carrying device 504.

Figure 6:
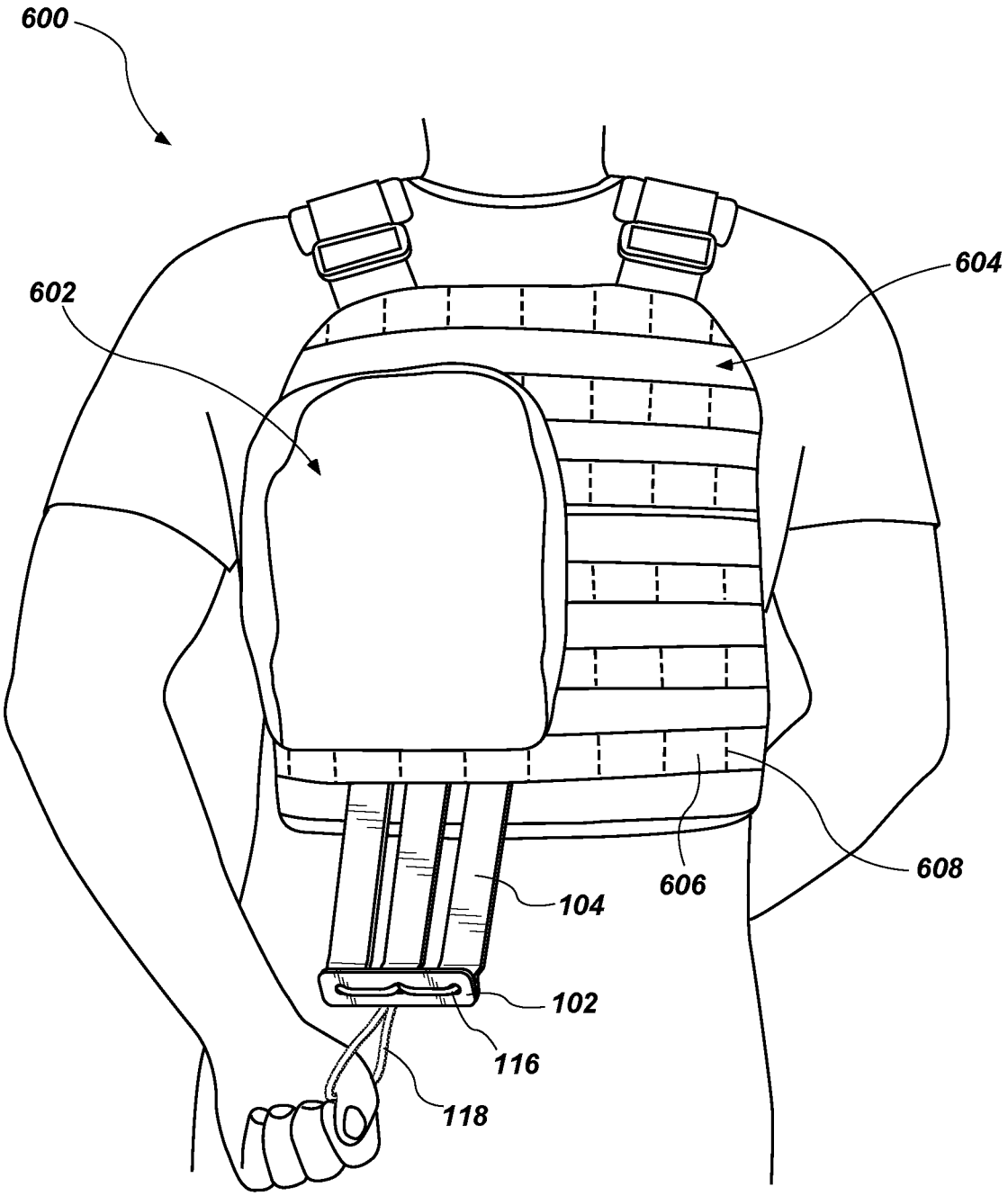
FIG. 6 illustrates a removal of an attachment apparatus to release an accessory, according to an embodiment of the disclosure.

FIG. 6 illustrates another method for the removal 600 of an attachment apparatus 100, such that an accessory 602 of a PALS/MOLLE system is released from the carrying device 604 of the PALS/MOLLE system. The attachment apparatus 100 is pulled downward at the loop 118 or other structure such that the bridge 102 and connectors 104 of the attachment apparatus 100 are pulled downward and out of the loops of the accessory 602 and carrying device 604. As illustrated in FIG. 6, the loops 606 of the carrying device 604 are constructed such that horizontal strips of fabric are disposed across the carrying device 604 and stitching 608 is provided therein to create each of the plurality of loops 606.

FIG. 7 illustrates various perspective and side views of an embodiment of a connector 104 of an attachment apparatus 100. The connector 104 illustrated includes a first end 106, a body portion 108, and a second end 110. A hole is disposed through the connector 104 at the first end 106. Alternatively, the connector 104 may include a plurality of holes disposed therethrough at any suitable position, including along the entire length at consistent or varying intervals, at the second end 110, or at any point in the body portion 108. Additionally, it should be appreciated that the connector 104 may include a single hole that is not located at the first end 106 and is instead located at any other position along the length of the connector 104. The first end 106 includes an angled portion 122. The second end 110 includes a first angled portion 112 and a second angled portion 114.

Referring back to FIG. 4, a method of installing and removing an accessory to the PALS/MOLLE foundation with the attachment apparatus 100 is initiated by inserting the second end 110 (i.e. the distal end) of the connector 104 under the first selected webbing loop 408 in the PALS/MOLLE foundation. The connector 104 is then woven/inserted through the webbing loop 406 on the PALS/MOLLE compatible accessory. This weaving process repeats, following the 408, 406 path until the PALS/MOLLE loops have covered the length of the body portion 108 of the stiff connector 104, there are no more PALS/MOLLE loops through which to weave, and the first end 106 and the second end 110 of the connector 104 exceed the outermost edge of the last PALS/MOLLE loops. The connector 104 may be produced in a variety of lengths; however, the installation process is the same for any length connector 104.

EXAMPLES

The following examples pertain to further embodiments:

Example 1 is an apparatus for securing an accessory to a modular load-carrying device. The apparatus includes a bridge and a connector comprising a first end, a body portion, and a second end, wherein the connector is configured to attach the accessory to the modular load-carrying device. The apparatus includes an attachment mechanism securing the connector to the bridge.

Example 2 is an apparatus as in Example 1, wherein the connector comprises two or more connectors attached to the bridge with the attachment mechanism.

Example 3 is an apparatus as in any of Examples 1-2, wherein the bridge comprises a bridge hole disposed therethrough and wherein the first end of the connector comprises a connector hole disposed therethrough and wherein the attachment mechanism comprises a cord securing the connector to the bridge such that the cord passes through the bridge hole and the connector hole.

Example 4 is an apparatus as in any of Examples 1-3, wherein the second end of the connector comprises an angled portion relative to the body portion of the connector.

Example 5 is an apparatus as in any of Examples 1-4, wherein the first end of the connector comprises an angled portion relative to the body portion of the connector, wherein the angled portion of the first end is angled in a direction the same as a direction of the angled portion of the second end of the connector.

Example 6 is an apparatus as in any of Examples 1-5, wherein the bridge comprises two or more bridge holes disposed therethrough, and wherein the apparatus comprises two or more connectors attached to the bridge at the two or more bridge holes.

Example 7 is an apparatus as in any of Examples 1-6, wherein the body portion of the connector comprises a flat surface, and wherein the connector is constructed of a flexible, semi-rigid or rigid material.

Example 8 is an apparatus as in any of Examples 1-7, wherein the cord is knotted where it passes through the bridge hole and the connector hole, and wherein the cord further comprises a loop extending outward from the bridge such that a user may grip the loop.

Example 9 is an apparatus as in any of Examples 1-8, wherein the angled portion of the second end of the connector comprises a first angled portion and a second angled portion, wherein the first angled portion is disposed a direction opposite a direction of the second angled portion relative to the body portion of the connector.

Example 10 is an apparatus as in any of Examples 1-9, wherein the connector is configured to pass through a loop of the modular load-carrying device such that the apparatus secures the accessory to the modular load-carrying device.

Example 11 is an apparatus as in any of Examples 1-10, wherein the angled portion of the second end of the connector is oriented inward toward the modular load-carrying device when the apparatus secures the accessory to the modular load-carrying device, such that the angled portion of the second end of the connector stabilizes the apparatus against the modular load-carrying device.

Example 12 is an apparatus as in any of Examples 1-11, wherein the cord further comprises a loop configured to be pulled by a user, and wherein the apparatus is configured to secure the accessory to the modular load-carrying device such that the apparatus enables a quick-release of the accessory from the modular load-carrying device when the loop is pulled.

Example 13 is an apparatus as in any of Examples 1-12, wherein the connector is attached to the bridge only via the cord such that the connector may pivot relative to the bridge, and wherein the connector is disposed approximately normal to the bridge when the apparatus secures the accessory to the modular load-carrying device.

Example 14 is a system. The system includes a modular load-carrying device and an accessory compatible with the modular load-carrying device and configured to be releasably secured to the modular load-carrying device. The system includes an attachment apparatus for securing the accessory to the modular load-carrying device. The attachment apparatus includes a bridge and a connector comprising a first end, a body portion, and a second end. The attachment apparatus includes an attachment mechanism securing the connector to the bridge.

Example 15 is a system as in Example 14, wherein the connector comprises two or more connectors attached to the bridge with the attachment mechanism.

Example 16 is a system as in any of Examples 14-15, wherein the bridge comprises a bridge hole disposed therethrough and wherein the first end of the connector comprises a connector hole disposed therethrough and wherein the attachment mechanism comprises a cord securing the connector to the bridge such that the cord passes through the bridge hole and the connector hole.

Example 17 is a system as in any of Examples 14-16, wherein the second end of the connector of the attachment apparatus comprises an angled portion relative to the body portion of the connector.

Example 18 is a system as in any of Examples 14-17, wherein the bridge of the attachment apparatus comprises two or more bridge holes disposed therethrough, and wherein the attachment apparatus comprises two or more connectors attached to the bridge.

Example 19 is a system as in any of Examples 14-18, wherein the modular load-carrying device further comprises a plurality of loops and the accessory further comprises a plurality of loops of similar size and shape to the plurality of loops of the modular load-carrying device.

Example 20 is a system as in any of Examples 14-19, wherein the connector of the attachment apparatus is configured to be disposed through one or more of the plurality of loops of each of the modular load-carrying device and the accessory.

Example 21 is a system as in any of Examples 14-20, wherein the cord further comprises a loop configured to be pulled by a user, and wherein the attachment apparatus is configured to secure the accessory to the modular load-carrying device such that the attachment apparatus provides a quick release to remove the accessory from the modular load-carrying device when the loop is pulled.

Example 22 is a system as in any of Examples 14-21, wherein the first end of the connector of the attachment apparatus comprises an angled portion relative to the body portion of the connector, wherein the angled portion of the first end is angled in a direction the same as a direction of the angled portion of the second end of the connector.

Example 23 is a system as in any of Examples 14-22, wherein the body portion of the connector of the attachment apparatus comprises a flat surface, and wherein the connector is constructed of a flexible, semi-rigid or rigid material.

Example 24 is a system as in any of Examples 14-23, wherein the modular load-carrying device comprises a pouch attachment ladder system (PALS), and wherein the accessory further comprises a coordinating PALS.

Example 25 is a system as in any of Examples 14-24, wherein the accessory is secured to the modular load-carrying device via the attachment apparatus only, and wherein the attachment apparatus provides a quick-release such that the accessory is removed from the modular load-carrying device when a user removes the attachment apparatus.

Example 26 is a system as in any of Examples 14-25, wherein the bridge comprises a first bridge and a second bridge and the connector comprises a plurality of connectors that each have a first end, a body portion, and a second end, wherein the first bridge is attached to the first end of the plurality of connectors and the second bridge is attached to the second end of the plurality of connectors to lock the plurality of connectors at the first end and the second end.

Example 27 is an apparatus as in any of Examples 1-13, wherein the bridge comprises a first bridge and a second bridge and the connector comprises a plurality of connectors that each have a first end, a body portion, and a second end, wherein the first bridge is attached to the first end of the plurality of connectors and the second bridge is attached to the second end of the plurality of connectors to lock the plurality of connectors at the first end and the second end.

The foregoing description has been presented for the purposes of illustration and description. It is not intended to be exhaustive or to limit the disclosure to the precise form disclosed. Many modifications and variations are possible in light of the above teaching. Further, it should be noted that any or all of the aforementioned alternate implementations may be used in any combination desired to form additional hybrid implementations of the disclosure.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

In the foregoing Detailed Description, various features of the disclosure are grouped together in a single implementation for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed implementation. Thus, the following claims are hereby incorporated into this Detailed Description by this reference, with each claim standing on its own as a separate implementation of the disclosure.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An apparatus for securing an accessory to a modular load-carrying device, comprising:

a plurality of connectors, wherein each of the plurality of connectors comprises a first end, a body portion, and a second end, wherein the plurality of connectors is configured to attach the accessory to the modular load-carrying device;

a bridge comprising one or more openings formed therein; and an attachment mechanism securing the plurality of connectors to the bridge via the one or more openings.

2. The apparatus of claim 1, wherein the one or more openings formed in the bridge are disposed therethrough and wherein the first end of each of the plurality of connectors comprises a connector opening disposed therethrough; and wherein the attachment mechanism comprises a cord securing at least one of the plurality of connectors to the bridge such that the cord passes through the one or more openings formed in the bridge and the connector opening.

3. The apparatus of claim 2, wherein the cord is knotted where it passes through the opening of the bridge and the opening of the connector, and wherein the cord further comprises a loop extending outward from the bridge such that a user may grip the loop.

4. The apparatus of claim 2, wherein the cord further comprises a loop configured to be pulled by a user, and wherein the apparatus is configured to secure the accessory to the modular load-carrying device such that the apparatus enables a quick-release of the accessory from the modular load-carrying device when the loop is pulled.

5. The apparatus of claim 2, wherein the at least one of the plurality of connectors is attached to the bridge only via the cord such that the at least one of the plurality of connectors may pivot relative to the bridge, and wherein the at least one of the plurality of connectors is disposed approximately normal to the bridge when the apparatus secures the accessory to the modular load-carrying device.

6. The apparatus of claim 1, wherein the second end of each of the plurality of connectors comprises an angled portion relative to the body portion of the connector.

7. The apparatus of claim 6, wherein the first end of each of the plurality of connectors comprises an angled portion relative to the body portion of the connector, wherein the angled portion of the first end is angled in a direction the same as a direction of the angled portion of the second end of the connector.

8. The apparatus of claim 6, wherein the angled portion of the second end of the connector comprises a first angled portion and a second angled portion, wherein the first angled portion is disposed a direction opposite a direction of the second angled portion relative to the body portion of the connector.

9. The apparatus of claim 6, wherein the angled portion of the second end of the connector is oriented inward toward the modular load-carrying device when the apparatus secures the accessory to the modular load-carrying device, such that the angled portion of the second end of the connector stabilizes the apparatus against the modular load-carrying device.

10. The apparatus of claim 1, wherein the bridge comprises two or more openings disposed therethrough, and wherein two or more connectors are attached to the bridge at the two or more openings of the bridge.

11. The apparatus of claim 1, wherein the body portion of each of the plurality of connectors comprises a flat surface, and wherein each of the plurality of connectors is constructed of a flexible, semi-rigid or rigid material.

12. The apparatus of claim 1, wherein each of the plurality of connectors is configured to pass through a loop of the modular load-carrying device such that the apparatus secures the accessory to the modular load-carrying device.

13. The apparatus of claim 1, wherein the bridge comprises a first bridge and a second bridge, wherein the first bridge is attached to the first end of the plurality of connectors and the second bridge is attached to the second end of the plurality of connectors to lock the plurality of connectors at the first end and the second end.

14. A system comprising:

a modular load-carrying device;

an accessory compatible with the modular load-carrying device and configured to be releasably secured to the modular load-carrying device;

an attachment apparatus for securing the accessory to the modular load-carrying device, wherein the attachment apparatus comprises:

a plurality of connectors, wherein each of the plurality of connectors comprises a first end, a body portion, and a second end;

a bridge comprising one or more openings formed therein; and an attachment mechanism securing the plurality of connectors to the bridge via the one or more openings.

15. The system of claim 14, wherein the one or more openings formed in the bridge are disposed therethrough and wherein the first end of each of the plurality of connectors comprises a connector opening disposed therethrough; and wherein the attachment mechanism comprises a cord securing at least one of the plurality of connectors to the bridge such that the cord passes through the one or more openings formed in the bridge and the connector opening.

16. The system of claim 15, wherein the bridge of the attachment apparatus comprises two or more openings disposed therethrough, and wherein the attachment apparatus comprises two or more connectors attached to the bridge.

17. The system of claim 14, wherein the second end of each of the plurality of connectors of the attachment apparatus comprises an angled portion relative to the body portion of the connector.

18. The system of claim 17, wherein the first end of each of the plurality of connectors of the attachment apparatus comprises an angled portion relative to the body portion of the connector, wherein the angled portion of the first end is angled in a direction the same as a direction of the angled portion of the second end of the connector.

19. The system of claim 14, wherein the modular load-carrying device further comprises a plurality of loops and the accessory further comprises a plurality of loops of similar size and shape to the plurality of loops of the modular load-carrying device.

20. The system of claim 19, wherein each of the plurality of connectors of the attachment apparatus is configured to be placed through one or more of the plurality of loops of each of the modular load-carrying device and the accessory.

21. The system of claim 15, wherein the cord further comprises a loop configured to be pulled by a user, and wherein the attachment apparatus is configured to secure the accessory to the modular load-carrying device such that the attachment apparatus provides a quick release to remove the accessory from the modular load-carrying device when the loop is pulled.

22. The system of claim 14, wherein the body portion of each of the plurality of connectors of the attachment apparatus comprises a flat surface, and wherein each of the plurality of connectors is constructed of a flexible, semi-rigid or rigid material.

23. The system of claim 14, wherein the modular load-carrying device comprises a pouch attachment ladder system (PALS), and wherein the accessory further comprises a coordinating PALS.

24. The system of claim 14, wherein the accessory is secured to the modular load-carrying device via the attachment apparatus only, and wherein the attachment apparatus provides a quick-release such that the accessory is removed from the modular load-carrying device when a user removes the attachment apparatus.

25. The system of claim 14, wherein the bridge comprises a first bridge and a second bridge, wherein the first bridge is attached to the first end of the plurality of connectors and the second bridge is attached to the second end of the plurality of connectors to lock the plurality of connectors at the first end and the second end.

* * * * *